United States Patent [19]

Bower et al.

[11] 4,310,268

[45] Jan. 12, 1982

[54] MINING EQUIPMENT

[75] Inventors: Lewis R. Bower; Arthur Scarfe, both of Wakefield, England

[73] Assignee: Fletcher Sutcliffe Wild Limited, Wakefield, England

[21] Appl. No.: 54,426

[22] Filed: Jul. 3, 1979

[30] Foreign Application Priority Data

Jul. 5, 1978 [GB] United Kingdom ..... 28937/78

[51] Int. Cl.[3] ..... E21D 23/00

[52] U.S. Cl. ..... 405/294; 405/296

[58] Field of Search ..... 405/291, 293, 294, 296; 299/33

[56] References Cited

U.S. PATENT DOCUMENTS 3,848,928 11/1974 Nakajima ..... 405/296 X

FOREIGN PATENT DOCUMENTS 1429799 3/1976 United Kingdom ..... 405/294

1494284 12/1977 United Kingdom .

*Primary Examiner*—David H. Corbin

*Attorney, Agent, or Firm*—Trexler, Bushnell & Wolters, Ltd.

[57] ABSTRACT

This invention relates to a face sprag for mining equipment, to a mine roof beam incorporating such a sprag and to a mine roof support provided with such a beam. The face sprag comprises a sprag plate, a piston and cylinder unit pivotally attached at one end about a first pivot axis to the sprag plate and at the other end about a second pivot axis to a portion of a support member, a link means pivotally attached at one end about a third pivot axis to the piston and cylinder unit and at the other end about a fourth pivot axis to the support member at a location spaced from the second pivot axis, all the pivot axes being parallel, and activation of the piston and cylinder unit urging the sprag plate, in use, into an operative position in engagement with the mineral face.

13 Claims, 2 Drawing Figures

MINING EQUIPMENT

Figure 1:
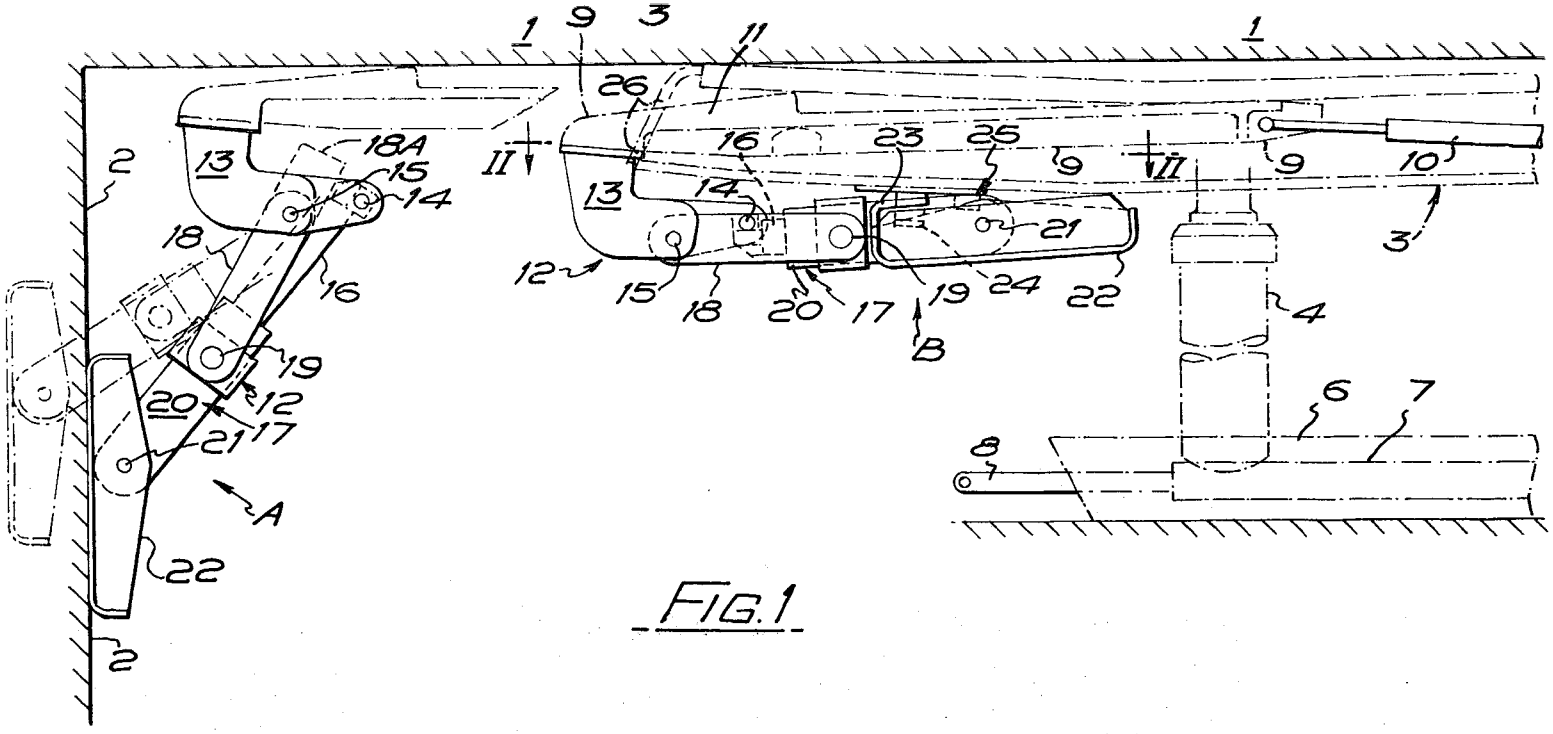

This invention relates to mining equipment in particular to a face sprag and mine roof support incorporating such a sprag.

Face sprags are employed in connection with coal mining operations for instance, where a relatively thick seam is involved, to prevent coal falling, usually in large pieces, from the face onto the conveyor. With large pieces the conveyor may become blocked and/or movement of one or more mineral winning devices may be obstructed and hence mining operations may have to be halted until the obstruction has been cleared.

Known face sprags comprise a sprag plate adapted to be urged into contact with the mineral face by a double-acting hydraulic ram. The extent of displacement required from this ram is relatively large and hence the ram is relatively long.

According to a first aspect of the present invention, a face sprag for mining equipment comprises a sprag plate, a piston and cylinder unit pivotally attached to one end about a first pivot axis to the sprag plate and at the other end about a second pivot axis to a portion of a support member, a link means pivotally attached at one end about a third pivot axis to the piston and cylinder unit and at the other end about a fourth pivot axis to the support member at a location spaced from the second pivot axis, all the pivot axes being parallel, and activation of the piston and cylinder unit urging the sprag plate, in use, into an operative position in engagement with the mineral face.

Although the piston and cylinder unit may be single acting, it is preferred that the piston and cylinder unit be double-acting, and preferably hydraulically actuated, whereby such unit may be employed not only for urging the sprag plate into its operative position in engagement with the mineral face, but also for displacing the sprag plate from its operative position to an inactive, storage position. Thus, when extended the piston and cylinder unit may displace the sprag plate to its operative position and when retracted displace the sprag plate to its inoperative position.

Preferably, the link means comprises a pair of spaced, parallel links embracing the piston and cylinder unit. The sprag plate is conveniently provided along its opposite lateral edges with flexible skirt members e.g. of rubber, conveyor belting etc. Such skirts act as shock absorbers when the face sprag is displaced and may also serve to contain folded hydraulic hoses.

According to a second aspect of the present invention, there is provided a mine roof beam incorporating at a forward end thereof a face sprag as defined above, the inoperative, storage position of the face sprag being beneath, but closely adjacent, an underside of the roof beam.

Preferably, the roof beam is a forepoling beam slidably carried by a main roof beam. Conveniently, displacement of the forepoling beam with respect to the main roof beam is effected by a double-acting ram, which is preferably hydraulically actuated.

In effect, to make the face sprag operative, it is in fact unfolded from its inoperative position beneath the roof beam. With a single acting piston and cylinder unit, the folding/unfolding operation is effected mechanically rather than hydraulically. Thus, to effect mechanical folding, after release of pressure in the piston and cylinder unit, the link means may extend slightly beyond its third pivot and the resulting projection can be arranged to strike the main roof beam during retraction of the forepoling beam, to fold the sprag plate, its piston and cylinder unit and the link means into a location beneath the main roof beam, by displacement about the fourth and second pivot axes respectively. It follows that when the forepoling beam is extended, the projection eventually disengages the main beam, and, assuming the piston and cylinder unit is not pressurised, the sprag plate, link means and cylinder unit fall to a generally vertical position by pivoting about the second and fourth axes. From this disposition, pressurisation of the piston and cylinder unit to cause its extension results in the sprag plate being urged into engagement with the mineral face, due to the spacing between the second and fourth pivot axes. Also, the line of action of the piston and cylinder unit may be slightly offset with respect to the second pivot axis.

Preferably, with a double-acting piston and cylinder unit, the face sprag is retained mechanically in the inoperative position by a catch arrangement mounted on the main roof beam. For instance, the catch arrangement may either be a linearly operative catch whereby an element of the sprag plate, preferably at both lateral sides thereof, engages an aperture in the catch arrangement upon retraction of the forepoling ram, or alternatively, spring loaded catches may be employed. With either embodiment it follows that when the forepoling ram is extended, the sprag plate disengages the catch arrangement and, assuming the piston and cylinder unit is not pressurised, the sprag plate, link means and piston and cylinder unit fall to a generally vertical position by pivoting about the second and fourth axes. From this disposition, pressurisation of the piston and cylinder unit to cause its extension results in the sprag plate being urged into engagement with the mineral face, due to the spacing between the second and fourth pivot axes.

According to a third aspect of the present invention, a self-advancing hydraulically powered mine roof support is provided with a mine roof beam as defined above.

The support member of the face sprag may simply take the form of a bracket which may be bolted to a main roof beam or to a forepoling beam.

Figure 2:
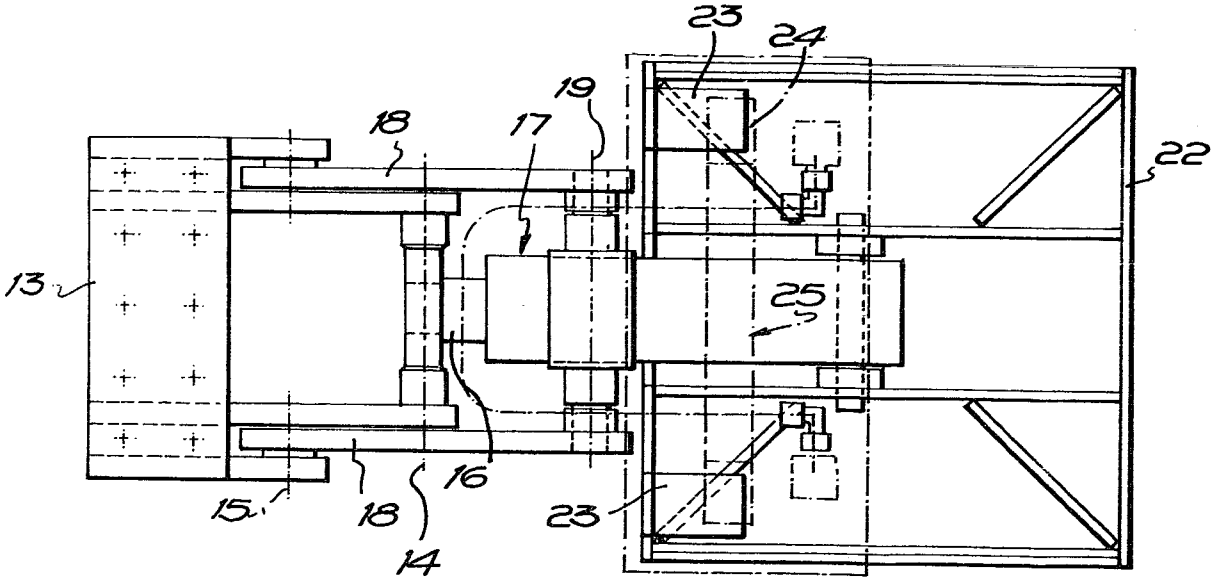

The invention will now be described in greater detail, by way of example, with reference to the accompanying drawings, in which:

FIG. 1 is a side elevation of a face sprag and an associated mine roof support in accordance with the present invention shown in both the active and inactive positions of the face sprag; and FIG. 2 is a plan view on the line II—II of FIG. 1 in the direction of arrow II;

In the drawings, a mine roof is indicated at 1 and a mineral face at 2. A main roof beam 3 is in engagement with the roof 2 and is carried by a plurality of hydraulically extensible chock legs 4 which form part of a self-advancing, hydraulically extensible mine roof support 5, the legs seating on base means 6 incorporating an advancing ram 7 attached via piston rod 8 to an armoured conveyor (not shown) extending along the mineral face 2. A forepoling beam 9 is extendable and retractable with respect to the main beam 3 under the control of a double-acting ram 10, the forepoling beam 9 having a leading end 11 to which is bolted a face sprag 12 via its bracket 13, the latter providing second and fourth pivot axes 14 and 15 respectively for a piston rod 16 of a double-acting, hydraulic piston and cylinder unit 17 and one end of each of a pair of spaced apart, parallel links 18. The links 18 are attached about a third pivot axis 19, to cylinder 20 of the piston and cylinder unit 17, while the latter is attached at a first pivot axis 21 to a sprag plate 22 shown in the operative position at A and in the inoperative position at B, where the sprag plate 22 lies closely adjacent the underside of the main roof beam 3. As can be seen from the drawings, the respective pivot axes are disposed parallel to each other, and also that the spacing between the second pivot axis 14 and the fourth pivot axis 15 is a distance less than the length of the link means 18 in order to permit movement from the operative position A to the inoperative position at B. As also can be seen at position B, the sprag plate 22 is provided at opposite lateral sides with a projecting element 23 in engagement with apertures 24 of a catch arrangement 25 mounted on the underside of the main roof beam 3. From the folded position B, upon extension of the forepoling ram 10, the projecting elements 23 become disengaged from the catch arrangement 25. If the piston and cylinder unit 17 is not pressurised, the elements 16–22 fall to a generally vertical position. If the piston and cylinder unit is pressurised, then extension of the piston rod 16 pivots the elements 16–22 from position B to position A. To return to position B, the piston and cylinder unit 17 is retracted and thereafter the ram 10 is retracted until eventually the projecting elements 23 engage the apertures 24.

If the piston and cylinder unit 17 were single-acting, then it would be necessary to displace the elements 16–22 mechanically to the folded, inoperable position B. This can be achieved by providing the links 18 with extensions 18A, beyond the fourth pivot axis 14, which extensions 18A, when the ram 10 is retracted to slide the forepoling beam 9 into the main beam 3, strikes a leading end 26 of the main beam 3, so that the elements 16–22 are rotated anti-clockwise, about the second and fourth pivot axes 14 and 15, to attain the folded position B.

Such arrangement in accordance with the invention, results in a piston and cylinder unit 17 with a stroke of approximately 1-ft. achieving the same function of a conventional sprag plate advancing ram of several feet in length.

What is claimed is:

1. A face sprag arrangement for supportingly engaging a mineral face and forming part of mining equipment, comprising a sprag plate, a generally elongate support member attachable to a section of mining equipment having a supported end and a free end, a piston and cylinder unit pivotally attached at one end about a first pivot axis to said sprag plate and at the other end about a second pivot axis to said support member proximate the free end thereof, a link means pivotally attached at one end about a third pivot axis to said piston and cylinder unit and at the other end about a fourth pivot axis to said support member at a second location also proximate said free end, but spaced from said second pivot axis, the spacing between said second and fourth pivot axes being less than the length of said link means, all said pivot axes being parallel, and said piston and cylinder unit being extendable for urging said sprag plate into a position for supporting engagement with said mineral face and retractable to retract said sprag plate from said mineral face supporting position, said piston and cylinder unit being rotatable between an operative, face supporting position and an inoperative, storage position, with the locating of the second and fourth pivot axes proximate the free end of said support member permitting said piston and cylinder unit to extend generally toward said mineral face when said unit is in the operative position to bring the sprag plate into engagement with said mineral face, and further permitting said piston and cylinder unit, when in the inoperative position, to extend generally away from said mineral face enabling said sprag plate to be disposed closely adjacent the underside of said support member in a folded, inoperative position.

2. A face sprag arrangement as claimed in claim 1, wherein said piston and cylinder unit is double-acting.

3. A face sprag arrangement as claimed in claim 1, wherein said piston and cylinder unit is single-acting.

4. A face sprag arrangement as claimed in claim 1, wherein said link means comprises a pair of spaced, parallel links embracing said piston and cylinder unit.

5. A mine roof beam incorporating at a forward end thereof a face sprag arrangement as defined in claim 1, and wherein the folded inoperative, storage position for said face sprag being beneath, but closely adjacent, an underside of said roof beam.

6. A mine roof beam as claimed in claim 5, wherein said support member is a forepoling beam slidably carried by a main roof beam.

7. A mine roof beam as claimed in claim 6, wherein displacement of said forepoling beam with respect to said main roof beam is effected by a double-acting hydraulic ram.

8. A mine roof beam as claimed in claim 5, comprising mechanical means to displace said sprag plate to said inoperative, storage position.

9. A mine roof beam as claimed in claim 8, wherein said mechanical means comprises extensions on said link means adapted to strike a main roof beam.

10. A mine roof beam as claimed in claim 5, wherein said face sprag is retained mechanically in its inoperative, storage position by a catch arrangement.

11. A mine roof beam as claimed in claim 10, wherein said catch arrangement is a linearly operative catch, an element of the sprag plate at opposite lateral sides thereof engaging an aperture in the catch arrangement upon retraction of a forepoling ram, and disengaging upon extension of said forepoling ram.

12. A mine roof beam as claimed in claim 5, wherein said support member takes the form of a bracket secured to a forepoling beam.

13. A self-advancing hydraulically powered mine roof support provided with a mine roof beam as defined in claim 5.

* * * * *